US005986197A

United States Patent [19]

Allen

[11] Patent Number: 5,986,197

[45] Date of Patent: Nov. 16, 1999

[54] PEDAL ACTUATED PERCUSSION DAMPER

[76] Inventor: Peter J. Allen, 145 S. Meadow Rd., Plymouth, Mass. 02360

[21] Appl. No.: 09/236,702

[22] Filed: Jan. 25, 1999

[51] Int. Cl.[6] ..... G10D 13/02

[52] U.S. Cl. ..... 84/411 M; 84/422.3; 84/421

[58] Field of Search ..... 84/411 M, 422.3, 84/421

[56] References Cited

U.S. PATENT DOCUMENTS 3,951,032 4/1976 LaPorta et al. ..... 84/411 M 5,877,440 3/1999 Chaffee et al. ..... 84/411 M

*Primary Examiner*—Jonathan Wysocki
*Assistant Examiner*—Shih-yung Hsieh
*Attorney, Agent, or Firm*—Leonard J. Janowski

[57] ABSTRACT

A method and apparatus permitting the player of a set of drums such as bongo or conga drums to alter the character of the sound produced, selectively and with complete freedom as to exactly when such effect will occur, through the use of a foot pedal which controls a set of damping elements mounted upon an adjacently located but separate damper arm and stand assembly.

8 Claims, 3 Drawing Sheets

PEDAL ACTUATED PERCUSSION DAMPER

BACKGROUND OF THE INVENTION

The present invention relates to an apparatus for use in conjunction with drums such as bongo or conga drums, the apparatus being capable of variably altering the sound characteristics produced when the drums are played, the apparatus being controlled by actuation of a foot pedal by the person playing the drums.

There are many types of apparatus described in the prior art which are designed to muffle or otherwise alter the sound produced when drums of various types are played. Some of these employ a simple "tuning" adjustment to be used before playing while others employ a foot pedal which is actuated during playing to achieve a desired end. Nothing in the prior art, however, shows a pedal actuated apparatus which can be used in conjunction with a separate set of free-standing drums to enable the player to variably alter the sound produced by the drums, the character and magnitude of the effect being controlled by the person playing the drums by varying the foot pressure used and the rhythm of pressure application.

U.S. Pat. No. 1,799,901 describes a combination drum and cymbal striker in which a foot operated drum striker is pivotally linked to a second arm adapted to strike a cymbal mounted at the edge of the drum head in a manner such that the drum head and cymbal are sounded simultaneously.

An apparatus designed to alter the sound produced by a drum while it is being played is shown in U.S. Pat. No. 2,198,406. Shown therein is a drum in combination with a supporting stand upon which is mounted a foot pedal mechanically connected to apparatus capable of varying the pressure with which wires or snares bear upon the head of the drum so as to permit a variety of tones to be obtained.

A type of drum muffler is disclosed in U.S. Pat. No. 2,499,616 in which an internally located, screw-threaded rod controlled by a finger grip mounted on the exterior shell of the drum is rotated to vary the pressure exerted on the two drum heads by interiorly mounted muffling pads.

U.S. Pat. No. 2,572,504 shows a drum in combination with a drum tone modulator in the form of a softening pad positioned within the drum and actuated by a cam mounted in the drum and operated by a lever pivotally mounted on the outer surface of the drum.

A drum set mounted on a collapsible support structure carrying an array of drums is described in U.S. Pat. No. 3,433,115. The drums are provided with internally mounted, snap action, muffling elements to permit them to be converted into a practice set.

In U.S. Pat. No. 3,951,032 there is shown a foot operated apparatus permitting a tympanist to mute or damp any of his tympani selectively by contacting the inner surface of the head of the instrument with a pair of arm-mounted damping elements.

An apparatus intended to be used in conjunction with a separate but adjacently located drum is shown in U.S. Pat. No. 4,028,984. As described, a foot operated apparatus for playing a cymbal, drum or similar band instrument is located adjacent such instrument so that actuation of a foot pedal mechanically raises and lowers a striking stick flexibly mounted on a rigid support arm connected to the foot pedal.

An improved cymbal stand and assembly is disclosed in U.S. Pat. No. 4,216,696 in the form of a stand- mounted cymbal employing a first pedal connected to a primary cymbal beating element and a second foot pedal controlling a cymbal vibration damper thereby allowing a single percussionist to produce a substantially more complex pattern of sounds.

Finally, U.S. Pat. No. 4,278,003 shows a drum in which pitch is adjusted by a pedal assembly connected by a wire cable to an actuating lever.

While the prior art shows a variety of approaches for altering the sound produced by percussion instruments by either striking or damping the vibrations by means of a foot pedal, none of the prior art arrangements are able to be used in the desirable fashion of the improved apparatus of this invention.

SUMMARY OF THE INVENTION

The invention may be summarized in specific terms as relating to a method and apparatus permitting the player of a set of drums such as bongo or conga drums to alter the character of the sound produced, selectively and with complete freedom as to exactly when such effect will occur through the use of a foot pedal which controls a set of damping elements mounted upon an adjacently located but separate damper arm and stand assembly.

It is, accordingly, an object of the invention to provide an apparatus and method to enable a person playing a set of drums to variably and controllably alter the qualities of the sound produced by the drums.

It is another object of the invention to provide an apparatus and method to accomplish the above without the use of the hands.

It is another object to provide an apparatus and method to accomplish the above while playing the instrumnent.

Yet another object of the invention is to augment the range of musical effects producible by the musician.

Another object is to provide an adjustable damping apparatus which may be used with different sets of drums.

A further object is to provide an apparatus which may be adjusted to accommodate the height or preferences of the musician and to accommodate the height of the drums.

Another object of invention is to provide an apparatus which may be adjusted to vary the location of damping contact on a set of drums.

Yet another object of the invention is the provision of an apparatus enabling a percussionist to produce a varying damping effect of his or her choice complementary to the rhythm produced by the hands.

The attainment of these and related objects may be achieved through the use of the pedal actuated percussion damper disclosed herein and will be more readily apparent after review of the following, more detailed description of the invention, taken together with the drawings in which:

DETAILED DESCRIPTION OF THE INVENTION

Figure 1:
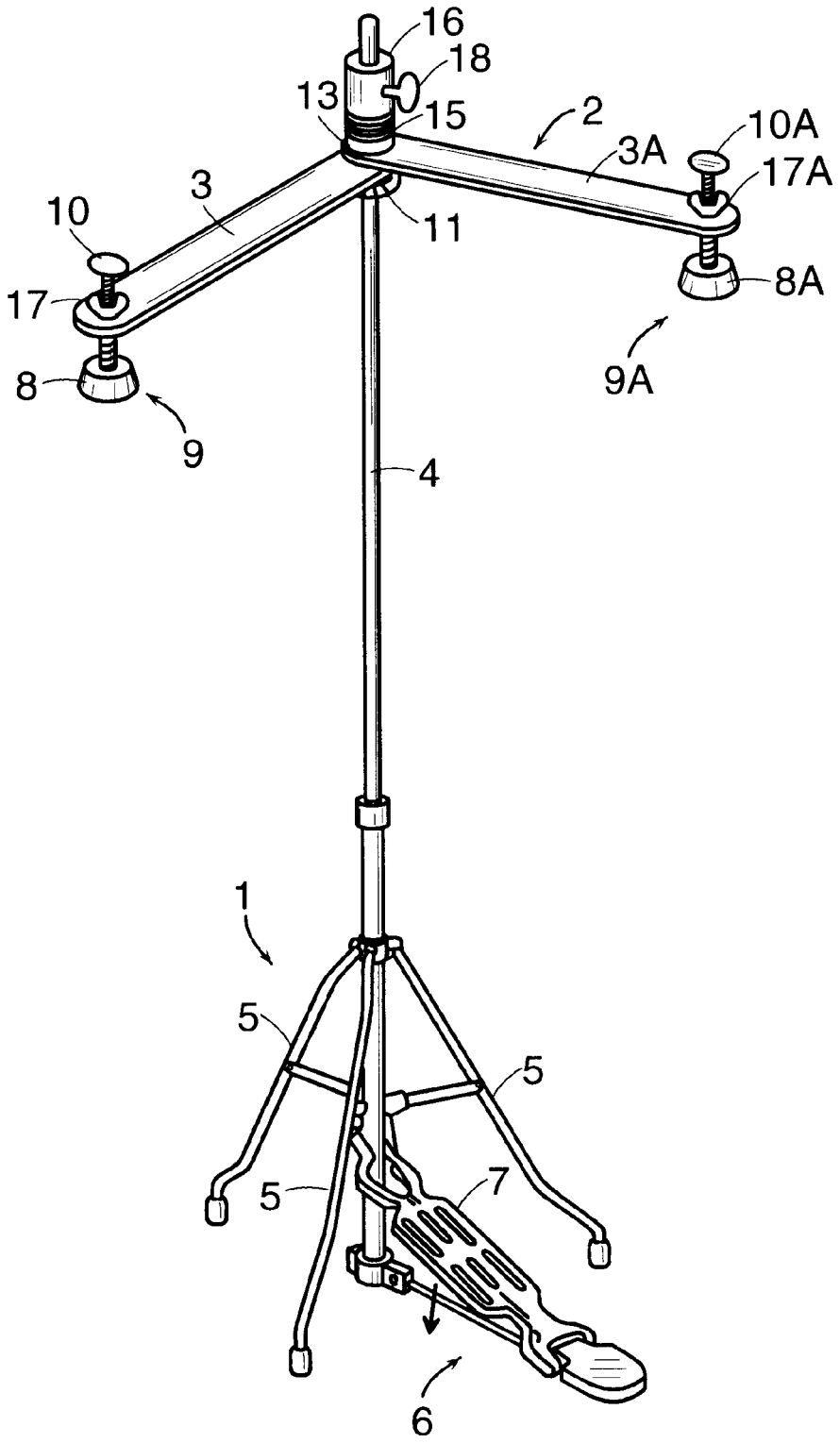
FIG. 1 is a perspective view of one embodiment of the invention.

In FIG. 1, a stand assembly 1 similar to a conventional hi-hat cymbal stand is illustrated with damper arm assembly 2 mounted at the upper end of traveling shaft 4. Traveling shaft 4 is mounted so as to slide vertically within the housing of stand assembly 1 which is supported by legs 5 and is mechanically linked through foot pedal assembly 6 to spring loaded foot pedal 7. When foot pedal 7 is depressed, traveling shaft 4 moves downwardly taking damper arm assembly 2 with it. When the foot pressure is removed from foot pedal 7, its spring loading causes it to move upwardly thus causing traveling shaft 4 to likewise move upwardly, moving the damper arm assembly 2 to its at-rest position.

In a preferred embodiment, damper arm assembly 2 is made up of two damper arms 3 and 3A, each carrying at its distal end a damping element 8 and 8A. Damper arms 3 and 3A are made of any sturdy material which is strong enough to remain essentially rigid when operated by foot pedal 7. A damper arm assembly suitable for use with a set of conventional bongo drums can be constructed from 3/16" thick aluminum with arms being about nine inches long and one and three quarter inches wide. Damping elements 8 and 8A may be made from hard rubber or other suitable material such as cork, wood, felt, metal or a synthetic material. While damping elements 8 and 8A are shown in FIG. 1 having flat damping surfaces 9 and 9A, they may also take other forms such as that of a sphere. As shown best in FIG. 1, the distal ends of damper arms 3 and 3A are drilled and tapped to receive thumbscrews 10 and 10A on the lower ends of which are mounted damping elements 8 and 8A . The vertical distance between the damping arms and the damping faces of the damping elements may be adjusted by turning thumbscrews 10 and 10A, using locking wing nuts 17 and 17A to retain the adjustment.

Figure 2:
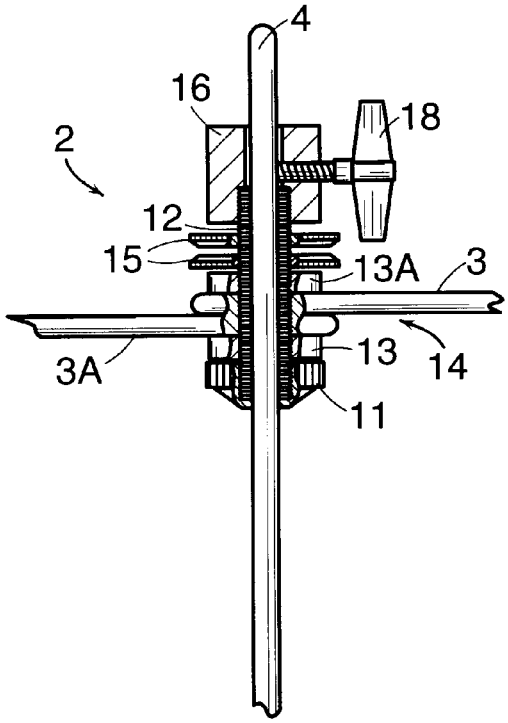
FIG. 2 is a side elevation view in partial cross section showing the details of a preferred damper arm assembly.

As shown in FIGS. 1 and 2, the inner ends of damper arms 3 and 3A are drilled with holes sized to fit over a mounting rod, in the form of threaded tube 12. The arms are assembled in a stacked relationship. If desired, they can be separated by a thin rubber washer (not shown) to provide frictional resistance when the arms are adjusted as described below. Also fitted over threaded tube 12 are Teflon washers 13 and 13A which act as spacers and also serve to separate the surfaces of damper arms 3 and 3A from lower locking nut 11 and upper dual locking nut 15 thus facilitating, when the locking nuts are loosened, lateral adjustment of the damper arms. Washers 13 and 13A, in addition to the functions enumerated above, help reduce equipment noise which may be generated by actuation of foot pedal 7. In addition to Teflon, other low friction materials may be used for washers 13 and 13A.

At the upper end of threaded tube 12 is located shaft locking collar 16 within which there is a suitably tapped hole receiving collar thumbscrew 18. In assembling damper arm assembly 2 upon traveling shaft 4, collar thumbscrew 18 is loosened sufficiently to allow the damper arm assembly to be slid over the traveling shaft through threaded tube 12. After vertically positioning the damper arm assembly, collar thumbscrew 18 is tightened to retain the position.

If desired, a pedal actuated percussion damper employing four adjustable damper arms may be constructed as described above. Such apparatus can be used to simultaneously, and with a single pedal action, alter the sound produced by two sets of drums, such as a set of bongo drums and a set of conga drums.

Figure 3:
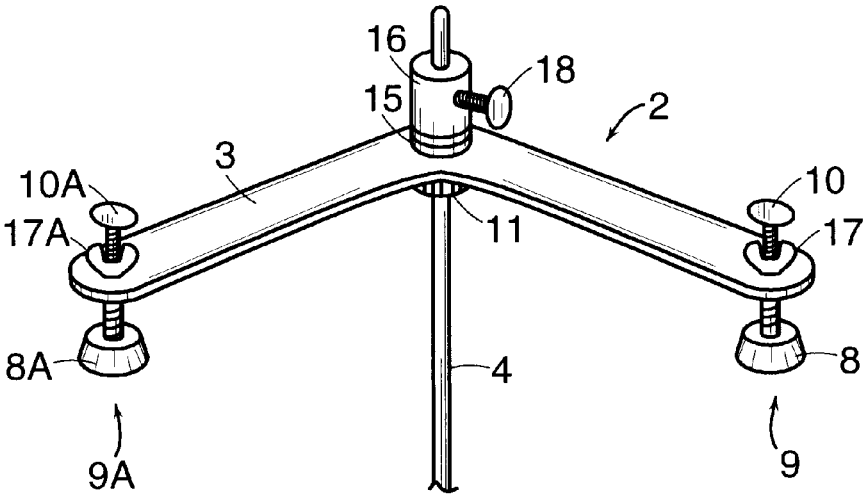
FIG. 3 is a perspective view of an alternative damper arm construction and FIG. 4 is a perspective view showing the relationship in use between the pedal actuated percussion damper and a set of drums.

An alternative embodiment of damper arm assembly 2 is shown in FIG. 3. In this embodiment a single, non-adjustable damper arm 3 is shown in the form of a boomerang-shaped member carrying at its distal ends damping elements 8 and 8A. In other respects, the construction and assembly of this embodiment follows the teaching provided herein.

Figure 4:
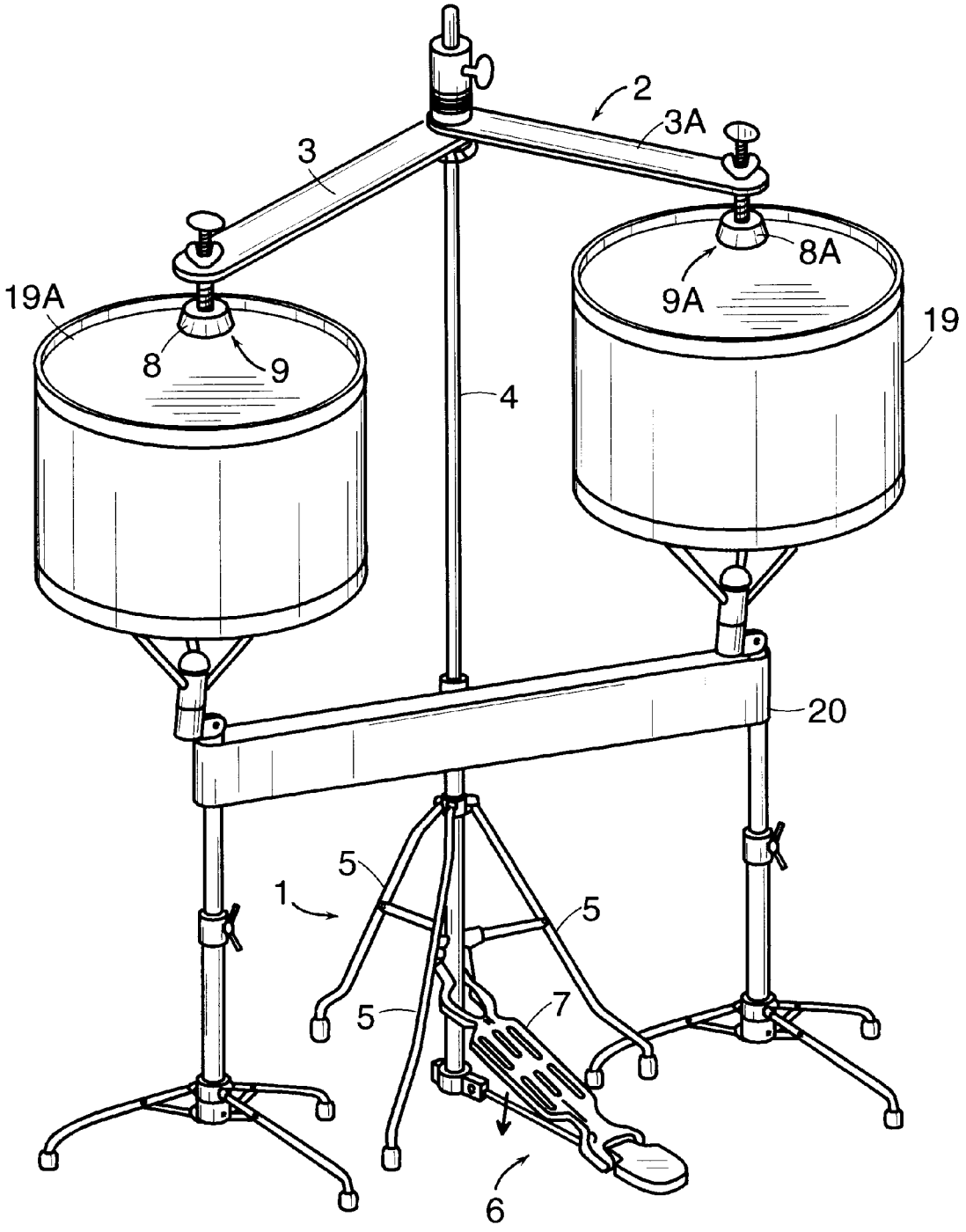

FIG. 4 shows the pedal operated percussion damper of this invention as it is positioned for use with a pair of drums. Drums 19 and 19A, supported by drum stand 20, are first positioned to suit the preferences of the percussionist. The damper assembly and stand are then positioned as shown so that the user has ready access to foot pedal 7 . By using collar thumbscrew 18, the height of the damper arm assembly on traveling shaft 4 is adjusted so that damping surfaces 9 and 9A are about one inch or less above the surfaces of the drum heads. A distance of about one quarter inch is usually suitable. Fine adjustment of the damping elements can be achieved using thumbscrews 10 and 10A and locking wing nuts 17 and 17A.

Dampers 8 and 8A are usually positioned over the rear part of the drumheads, about two to three inches in from the edge. Damper placement can be varied to effectively change both the quality of sound and the effect produced. The more centrally located the dampers, the more pronounced the dampening and other effects produced. However, if the dampers are too centrally located, they may obstruct the drum playing surfaces. The individual damper arms may be laterally adjusted with respect to each other to accommodate the apparatus to various types of drum sets or to meet the desires of the percussionist. This is achieved by loosening dual lock nuts 15, swingably moving the arms and then tightening the lock nuts to retain the position.

The pedal actuated percussion damper of this invention can be used with standard percussion instruments such as bongos, congas, doumbeks or any drum which can be mounted on a stand, at a working height for the damper arm assembly mounted on the stand carrying the foot pedal assembly. The damper arm assembly, as described herein, is intended to be mountable upon many existing designs of hi-hat cymbal stands with little or no modification.

In use, the foot pedal can dampen the drums for entire sections of songs by maintaining consistent foot pressure on the foot pedal. The foot pedal can also be used to rhythmically apply and remove damping, changing the sound of the drums while they are being played. If a dampened sound is desired continuously without applying pressure on the foot pedal, the damper assembly can be adjusted downwardly and locked into place on traveling shaft 4 with the damper elements pressing on the surface of the drum heads.

Once experienced in the use of the invention, the percussionist can actually play the damper pedal, keeping time with the rhythm of the percussion part being played by hand on the heads of the drums. If the percussionist uses the damper pedal on the two and four of the beat and dampens the heads for only an eigth note duration, only those notes striking the drum exactly on the two and four will have the higher or flatter dampened sound. The resulting rythmic pattern is uniquely different compared with the same drum part played without damping. Using the pedal more extensively can produce very sophisticated rhythm patterns and pitch variations given an active drum part and an experienced player.

While the present invention has been illustrated and described with respect to a presently preferred embodiment thereof, many variations and modifications of the concepts disclosed herein may be apparent to those skilled in the art, and it is intended that all such variations and modifications be encompassed within the scope of the appended claims.

I claim:

1. A damper arm assembly useful in altering the sound produced by an adjacently located array of percussion instruments such as bongo or conga drums, said assembly being mounted upon a vertically adjustable stand assembly having a foot pedal which is operatively connected to said damper arm assembly in a manner to control its up and down movement, said damper arm assembly comprising a damper arm in combination with a plurality of damping elements.

2. A damper arm assembly as described in claim 1 in which the distances between the damping surfaces of said damping elements and said damper arm are adjustable.

3. A damper arm assembly as described in claim 1 in which said assembly comprises a plurality of damper arm elements, each of which carries a damping element at one end of said damper arm element.

4. A damper arm assembly as described in claim 3 in which said damper arm elements are swingably connected to a mounting rod which passes through holes in said damper arm elements located at the ends remote from said damping elements.

5. A damper arm assembly as described in claim 1 in combination with a vertically adjustable stand assembly comprising a traveling shaft, a plurality of legs and a foot pedal operatively connected to said traveling shaft.

6. An apparatus useful in altering the sound produced by an adjacently located array of percussion instruments such as bongo or conga drums, said apparatus comprising a pair of swingably connected damper arms carrying, at their distal ends, adjustable damping elements, said damper arms being mounted upon a vertically adjustable stand assembly having a foot pedal which is operatively connected to said damper arms in a manner to control the up and down movement of said damper arms and said damping elements.

7. A method of altering the sound produced by a set of drums comprising the steps of locating said drums adjacent a foot pedal operated, damper arm assembly and, while playing said drums, causing the damper arm assembly to contact the drumheads by applying foot pressure to said foot pedal.

8. A method as described in claim 7 comprising the step of varying the pressure on the foot pedal while playing said drums to variably alter the drum pitch.

* * * * *